US005794370A

United States Patent [19]

Haagenstad et al.

[11] Patent Number: 5,794,370

[45] Date of Patent: Aug. 18, 1998

[54] TIERED TRENCHING BACKHOE APPARATUS

[76] Inventors: Ronald G. Haagenstad, 119 Summer Heavon Dr., Blackhawk, Colo. 80403-9032; Samuel Pratt, P.O. Box 5 Bedford Industrial Park, Bedford, Pa. 15522

[21] Appl. No.: 827,961

[22] Filed: May 13, 1997

Related U.S. Application Data

[63] Continuation of Ser. No. 679,851, Jul. 15, 1996.

[51] Int. Cl.[6] ..... E02F 3/96

[52] U.S. Cl. ..... 37/404; 37/407; 37/903; 414/724

[58] Field of Search ..... 37/403, 404, 405, 37/407, 903; 172/649; 414/724

[56] References Cited

U.S. PATENT DOCUMENTS

| | | | |
|---|---|---|---|
| 2,838,856 | 6/1958 | Buisse | 37/404 |
| 2,864,184 | 12/1958 | Fohr | 37/404 |
| 2,896,343 | 7/1959 | Raby | 37/407 |
| 3,181,256 | 5/1965 | Discenza | 37/404 |
| 3,307,277 | 3/1967 | Kondracki | 414/724 X |
| 3,478,449 | 11/1969 | Baker | 37/403 |
| 3,942,271 | 3/1976 | George | 37/404 |
| 4,009,529 | 3/1977 | Johnson | 37/404 |
| 4,038,766 | 8/1977 | Felstet | 37/404 X |
| 4,085,530 | 4/1978 | Laundry | 37/403 X |
| 4,360,980 | 11/1982 | Jarvis | 37/404 |
| 4,550,512 | 11/1985 | Felstet | 37/403 |
| 4,704,811 | 11/1987 | Jefferson | 37/364 |
| 5,212,897 | 5/1993 | Jefferson | 37/403 |

*Primary Examiner*—Tamara L. Graysay
*Assistant Examiner*—Thomas A. Beach

[57] ABSTRACT

A new Tiered Trenching Backhoe Apparatus for creating a dual tiered trench which allows one service utility to be elevated above another service utility thereby preventing contact of the two service utilities resulting in increased safety. The inventive device includes a syncline plate with an interior angle of approximately 140 degrees, a first and second triangular coupler welded at one end to the syncline plate removably coupling to a pair of existing tooth shanks of a backhoe bucket, a first and second fluke welded to the syncline plate opposite of the triangular couplers, a first and second trihedral support members welded to the interior portion of syncline plate providing support, and a pair of replaceable teeth removably secured to the first and second flukes.

2 Claims, 5 Drawing Sheets

FIG 3
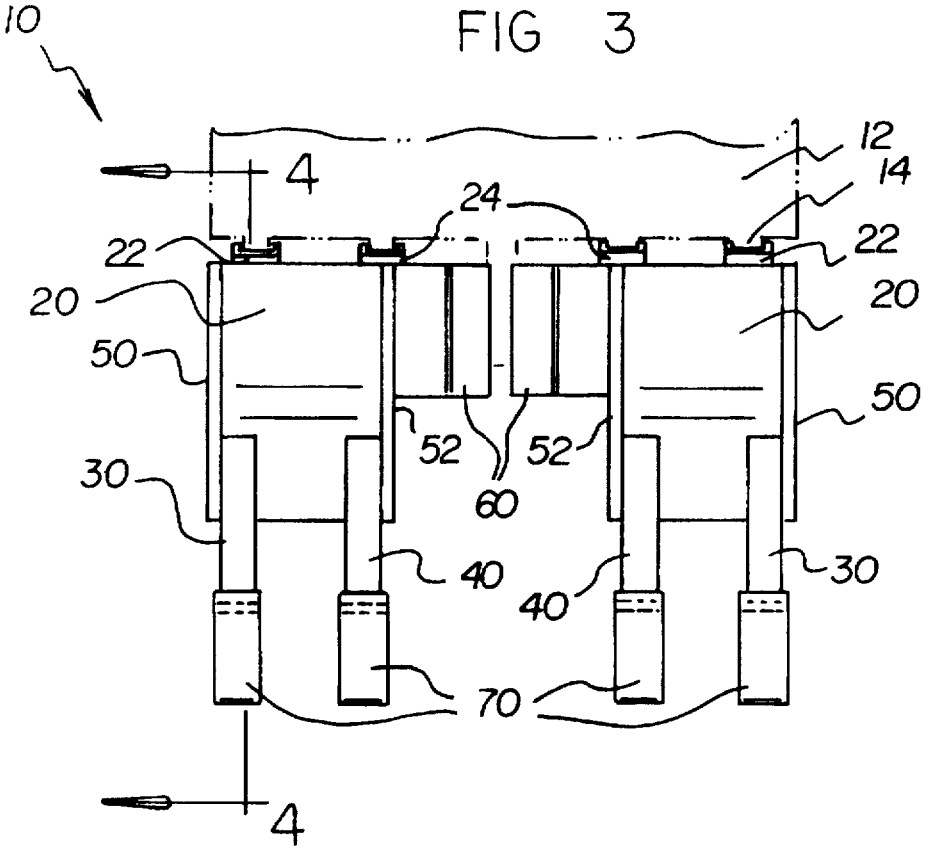
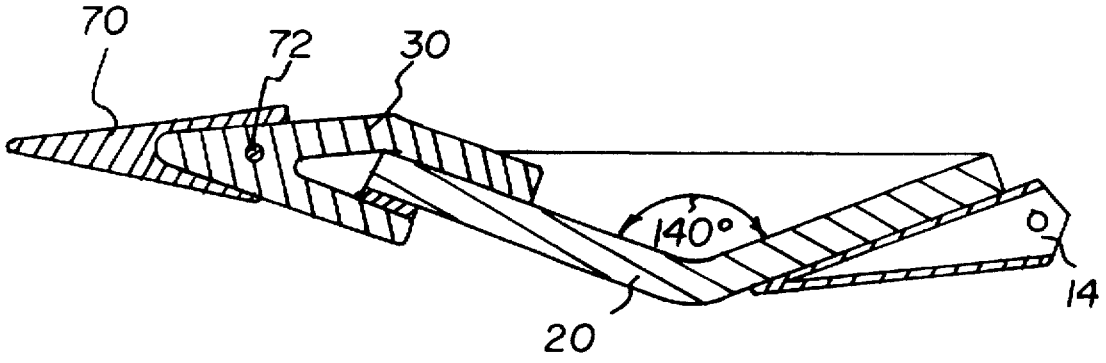
FIG 4

FIG 6
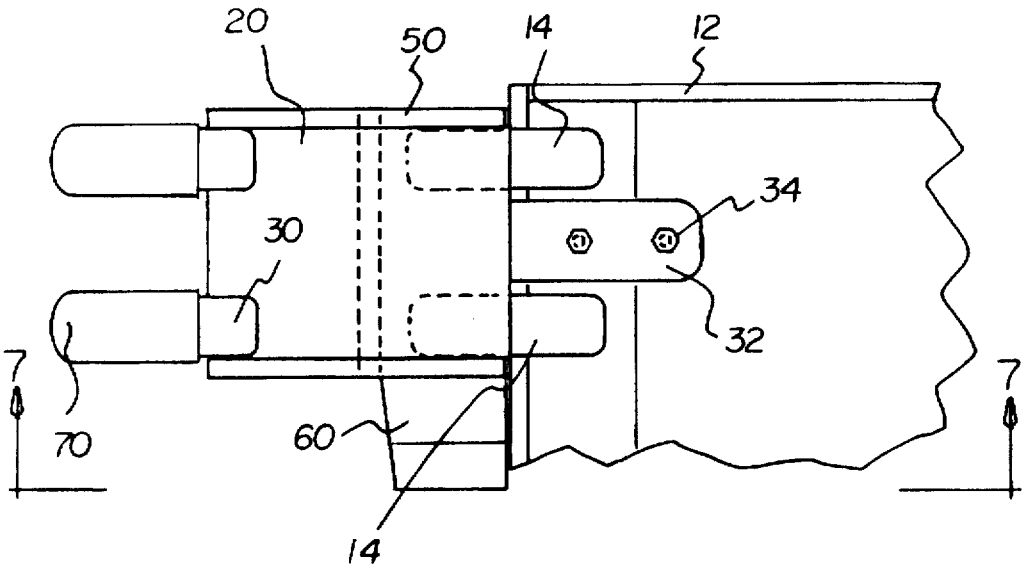
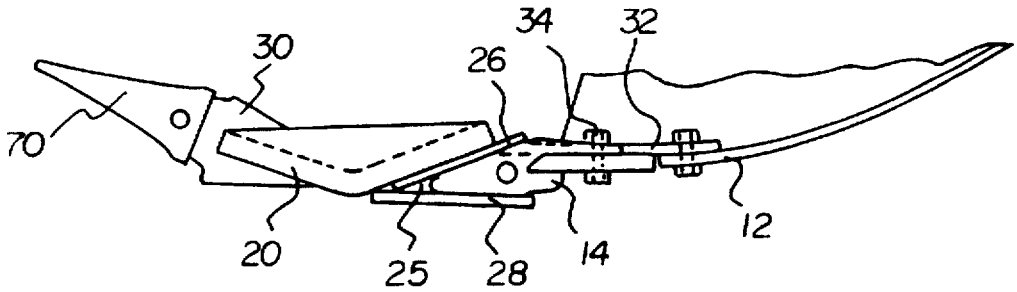
FIG 7

TIERED TRENCHING BACKHOE APPARATUS

CROSS REFERENCE TO RELATED APPLICATION

This application is a continuation-in-part of utility patent application Ser. No. 08/679,851, filed Jul. 15, 1996.

BACKGROUND OF THE INVENTION

1. Field of the Invention

The present invention relates to Trenching Devices and more particularly pertains to a new Tiered Trenching Backhoe Apparatus for creating a dual tiered trench which allows one service utility to be elevated above another service utility thereby preventing contact of the two service utilities resulting in increased safety.

2. Description of the Prior Art

The use of Trenching Devices is known in the prior art. More specifically, Trenching Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Trenching Devices include U.S. Pat. No. 5,212,897; U.S. Pat. No. 4,704,811; U.S. Pat. No. 5,197,212; U.S. Pat. No. 4,718,182; U.S. Pat. No. 4,360,980 and U.S. Design Pat. No. 264,213.

While these devices fulfill their respective, particular objectives and requirements, the aforementioned patents do not disclose a new Tiered Trenching Backhoe Apparatus. The inventive device includes a syncline plate with an interior angle of approximately 140 degrees, a first and second triangular coupler welded at one end to the syncline plate removably coupling to a pair of existing tooth shanks of a backhoe bucket, a first and second fluke welded to the syncline plate opposite of the triangular couplers, a first and second trihedral support members welded to the interior portion of syncline plate providing support, and a pair of replaceable teeth removably secured to the first and second flukes.

In these respects, the Tiered Trenching Backhoe Apparatus according to the present invention substantially departs from the conventional concepts and designs of the prior art, and in so doing provides an apparatus primarily developed for the purpose of creating a dual tiered trench which allows one service utility to be elevated above another service utility thereby preventing contact of the two service utilities resulting in increased safety.

SUMMARY OF THE INVENTION

In view of the foregoing disadvantages inherent in the known types of Trenching Devices now present in the prior art, the present invention provides a new Tiered Trenching Backhoe Apparatus construction wherein the same can be utilized for creating a dual tiered trench which allows one service utility to be elevated above another service utility thereby preventing contact of the two service utilities resulting in increased safety.

The general purpose of the present invention, which will be described subsequently in greater detail, is to provide a new Tiered Trenching Backhoe Apparatus and method of use which has many of the advantages of the Trenching Devices mentioned heretofore and many novel features that result in a new Tiered Trenching Backhoe Apparatus which is not anticipated, rendered obvious, suggested, or even implied by any of the prior art Trenching Devices, either alone or in any combination thereof.

To attain this, the present invention generally comprises a syncline plate with an interior angle of approximately 140 degrees, a first and second triangular coupler welded at one end to the syncline plate removably coupling to a pair of existing tooth shanks of a backhoe bucket, a first and second fluke welded to the syncline plate opposite of the triangular couplers, a first and second trihedral support members welded to the interior portion of syncline plate providing support, and a pair of replaceable teeth removably secured to the first and second flukes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Tiered Trenching Backhoe Apparatus and method of use which has many of the advantages of the Trenching Devices mentioned heretofore and many novel features that result in a new Tiered Trenching Backhoe Apparatus which is not anticipated, rendered obvious, suggested, or even implied by any of the prior art Trenching Devices, either alone or in any combination thereof.

It is another object of the present invention to provide a new Tiered Trenching Backhoe Apparatus which may be easily and efficiently manufactured and marketed.

It is a further object of the present invention to provide a new Tiered Trenching Backhoe Apparatus which is of a durable and reliable construction.

An even further object of the present invention is to provide a new Tiered Trenching Backhoe Apparatus which is susceptible of a low cost of manufacture with regard to both materials and labor, and which accordingly is then susceptible of low prices of sale to the consuming public, thereby making such Tiered Trenching Backhoe Apparatus economically available to the buying public.

Still yet another object of the present invention is to provide a new Tiered Trenching Backhoe Apparatus which provides in the apparatuses and methods of the prior art some of the advantages thereof, while simultaneously overcoming some of the disadvantages normally associated therewith.

Still another object of the present invention is to provide a new Tiered Trenching Backhoe Apparatus for creating a dual tiered trench which allows one service utility to be elevated above another service utility thereby preventing contact of the two service utilities resulting in increased safety.

Yet another object of the present invention is to provide a new Tiered Trenching Backhoe Apparatus which includes a syncline plate with an interior angle of approximately 140 degrees, a first and second triangular coupler welded at one end to the syncline plate removably coupling to a pair of existing tooth shanks of a backhoe bucket, a first and second fluke welded to the syncline plate opposite of the triangular couplers, a first and second trihedral support members welded to the interior portion of syncline plate providing support, and a pair of replaceable teeth removably secured to the first and second flukes.

Still yet another object of the present invention is to provide a new Tiered Trenching Backhoe Apparatus that can be utilized to step trench.

Even still another object of the present invention is to provide a new Tiered Trenching Backhoe Apparatus that is easy to install and remove from a backhoe bucket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a magnified rear view of the present invention.

FIG. 4 is a cross sectional view taken along line 4—4 of FIG. 3.

FIG. 6 is a fragmentary view of an optional embodiment of the invention particularly illustrating an optional means for mounting the invention on a backhoe bucket using a mounting strap.

FIG. 7 is a fragmentary sectional side view of the embodiment shown in FIG. 6 taken along line 7—7.

DESCRIPTION OF THE PREFERRED EMBODIMENT

Figure 1:
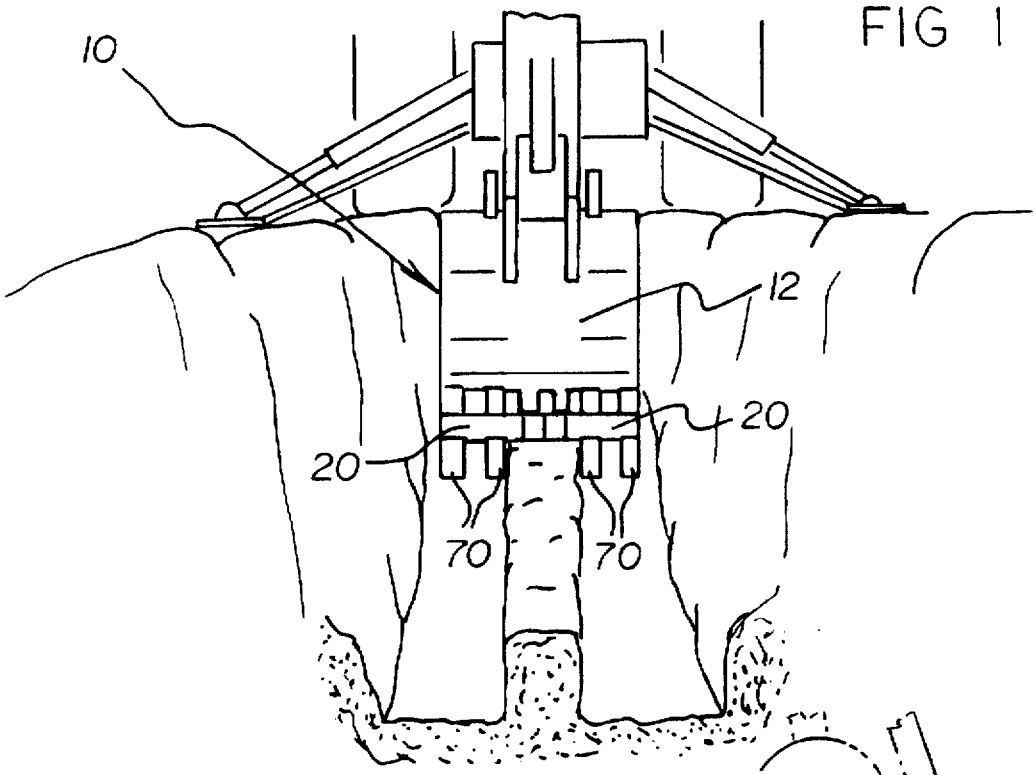
FIG. 1 is a rear view of a new Tiered Trenching Backhoe Apparatus according to the present invention.
Figure 2:
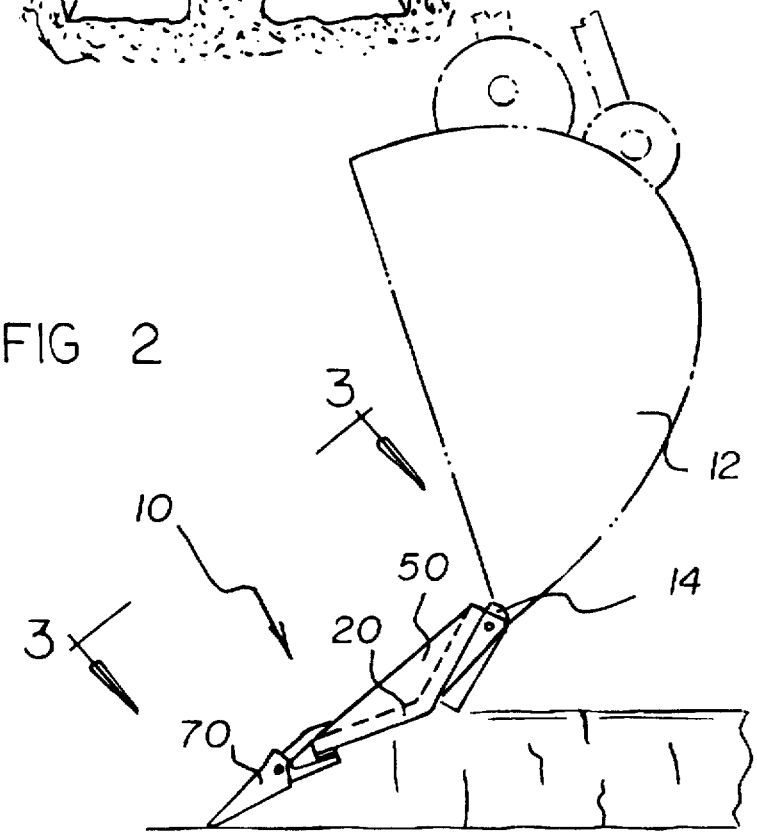
FIG. 2 is a side view thereof.

With reference now to the drawings, and in particular to FIGS. 1 through 8 thereof, a new Tiered Trenching Backhoe Apparatus embodying the principles and concepts of the present invention and generally designated by the reference numeral 10 will be described.

More specifically, it will be noted that the Tiered Trenching Backhoe Apparatus 10 comprises a syncline plate 20, a first fluke 30 secured at one end of the syncline plate 20 projecting orthogonal to the central bend within the syncline plate 20, a second fluke 40 secured at the end securing the first fluke 30 and projecting parallel to the first fluke 30, a first trihedral support member 50 secured to an elongated edge of the syncline plate 20 projecting orthogonal to the cornice of the syncline plate 20, a second trihedral support member 52 secured to the elongated edge of the syncline plate 20 opposite of the first trihedral support member 50 projecting parallel to said first trihedral support member 50, and a planar side member 60 secured to the side of the syncline plate 20 securing the second trihedral support member 52 and opposite of the first and second flukes 30, 40 projecting parallel to the syncline plate 20, where the planar side member 60 near the center includes a downward bend.

Figure 5:
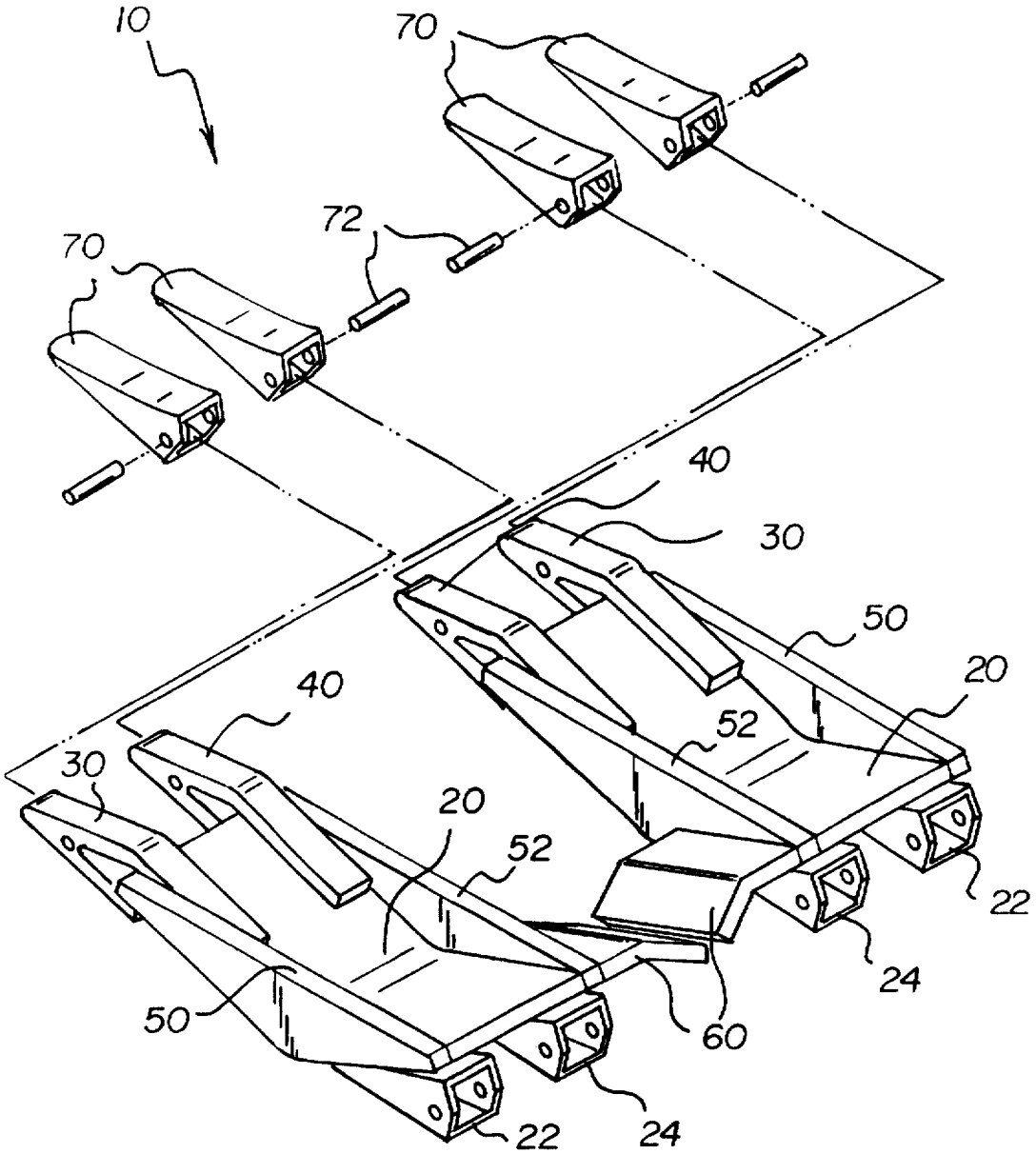
FIG. 5 is an exploded isometric view of the present invention.
Figure 8:
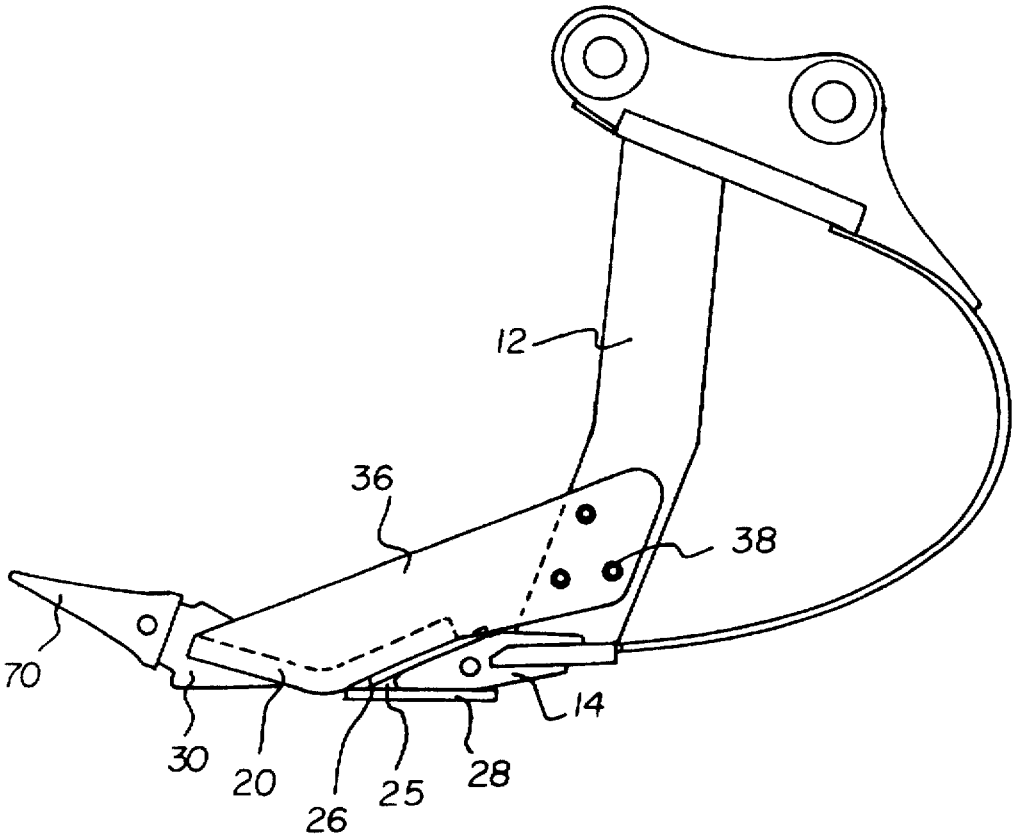
FIG. 8 is a side view of a backhoe bucket with an optional embodiment of the invention particularly illustrating another optional means for mounting the invention on a bucket using a lateral mounting plate.

As best illustrated in FIGS. 1 through 5, it can be shown that the syncline plate 20 includes a first triangular coupler 22 secured to the end opposite of the first and second flukes 30, 40, and projecting parallel to said flukes 30, 40. A second triangular coupler 24 is secured to the end securing the first triangular coupler 22, and projecting parallel to the first triangular coupler 22. The first and second triangular couplers 22, 24 removably attach to a pair of existing tooth shanks 14 secured to a backhoe bucket 12 thereby removably attaching the present invention. A pair of replaceable teeth 70 removably attach to the first and second flukes 30, 40 by a pair of teeth coupling pins 72 projecting through as best shown in FIG. 5 of the drawings. The syncline plate 20 preferably has an interior angle of approximately 140 degrees. All of the components are preferably welded together by continuous welds. The first and second triangular couplers 22, 24 either connect to the two rightmost existing tooth shanks 14, the two centermost existing tooth shanks 14, or the two leftmost existing tooth shanks 14 leaving a tier within the trench as shown in FIG. 1 of the drawings. The present invention also includes another mirrored invention which can be secured opposite of the first invention as disclosed in FIG. 1 of the drawings.

The first 22 and second 24 triangular couplers work well for bucket applications where the bucket's existing tooth shanks 14 are mounted at standardized or consistent spacing intervals such that the couplers 22, 24 are easily and consistently alignable with the mounted positions of the tooth shanks 14. An optional embodiment of the invention employing an alternate means for mounting the invention to the bucket 12 (shown in FIGS. 6 through 8) permits mounting on buckets 12 having irregular or non-standard spacing between the tooth shanks 14. Significantly, the optional mounting means also permits mounting of the invention to buckets where one or more of the tooth shanks are not parallel but are angled with respect to each other.

The alternate mounting means employs an elongated pocket 25 for receiving one or more tooth shanks 14 mounted on the bucket 12 at various spacings or angles (or other mounting structures forming a part of the bucket). The pocket 25 is fixedly attached or mounted to the syncline plate 20 at a location opposite the flukes 30, 40. The pocket 25 preferably extends along substantially the entire rear portion of the syncline plate 20 to permit the pocket to readily accept one or more tooth shanks 14 mounted at various locations and spacings on the bucket 12 (without being limited to only one shank position or spacing).

The most preferred pocket 25 is formed by upper 26 and lower 28 elongate pocket plates which are fixedly mounted to each other at an acute angle generally corresponding to the angle of a tooth shank 14 such that the upper pocket plate 26 is able to parallelly abut against the upper surface of a tooth shank and the lower pocket plate 28 is able to parallelly abut against the lower surface of the tooth shank.

A retaining means is preferably employed to keep the tooth shanks 14 wedged to lodged in the pocket 25. One retaining means comprises a mounting strap 32 (see FIGS. 6 and 7) that extends from the rear portion of the syncline plate 20 for positioning between the tooth shanks 14 mounted on a bucket 12. The mounting strap 32 is fastened to the bucket 12, preferably using removable fasteners 34 (such as bolts) passing through holes in the bucket wall, although more permanent fastening means such as welding may optionally be employed. The mounting strap 32 may be mounted on an upward surface location on the bucket leading edge or on a downward surface location on the bucket, or on both the upward and downward surfaces (e.g., using two mounting straps). Preferably, the upward surface mounting is employed to facilitate an easier mounting operation.

An optional retaining means comprises a lateral mounting plate 36 fixedly mounted on the syncline plate 20 and removably fastenable to the lateral side wall of a bucket. Preferably, the lateral mounting plate 36 replaces (or forms a rearward extension of) the first trihedral support member 50 and is permanently mounted to the lateral side edge of the syncline plate 20. The lateral mounting plate 36 extends rearwardly and upwardly from the syncline plate 20 to a position adjacent to the lateral side wall of the bucket 12, and removable fasteners 38 connect the plate 36 to the bucket side wall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tiered trenching backhoe apparatus comprising:

a trenching plate having a transverse bend therein located between substantially planar first and second plate portions or said trenching plate, said trenching plate having first and second end edges oriented substantially parallel to said transverse bend and having lateral side edges extending between said end edges;

a first tooth mount secured to said first end edge of the trenching plate and protecting in a direction substantially orthogonal to said first end edge;

a second tooth mount secured to said first end edge and projecting from said first end edge in an orientation substantially parallel to the first tooth mount;

a planar side member secured to the lateral side edge of the trenching plate adjacent to a trihedral support member and projecting substantially parallel to a plate portion of said trenching plate;

wherein said planar side member includes a downward bend therein at a location spaced from said lateral side edge; and a mounting pocket mounted on said trenching plate for receiving at least one tooth shank of a backhoe bucket; and a mounting strap for holding said pocket in an abutted condition to a tooth shank of a backhoe bucket, said mounting strap being mounted to said mounting pocket and extending from said mounting pocket for mounting to the bucket.

2. A tiered trenching backhoe apparatus comprising:

a trenching plate having a transverse bend therein located between substantially planar first and second plate portions of said trenching plate, said trenching plate having first and second end edges oriented substantially parallel to said transverse bend and having lateral side edges extending between said end edges having first and second trihedral support members mounted thereto;

a first tooth mount secured to said first end edge of the trenching plate and projecting in a direction substantially orthogonal to said first end edge;

a second tooth mount secured to said first end edge and projecting from said first end edge in an orientation substantially parallel to the first tooth mount;

a planar side member secured to the lateral side edge of the trenching plate adjacent to said second triliedral support member and projecting substantially parallel to a plate portion of said trenching plate;

wherein said planar side member includes a downward bend therein at a location spaced from said lateral side edge; and a mounting pocket mounted on said trenching plate for receiving at least one tooth shank of a backhoe bucket; and a lateral mounting plate for holding said pocket in an abutted condition to a tooth shank of a backhoe bucket, said lateral mounting plate extending from said first trihedral support member for attachment to a side of said backhoe bucket.

* * * * *